United States Patent [19]

Straubel et al.

[11] 4,306,528

[45] Dec. 22, 1981

[54] FUEL INJECTION APPARATUS FOR INTERNAL COMBUSTION ENGINES, PARTICULARLY DIESEL ENGINES

[75] Inventors: Max Straubel; Konrad Eckert, both of Stuttgart, Fed. Rep. of Germany

[73] Assignee: Robert Bosch GmbH, Stuttgart, Fed. Rep. of Germany

[21] Appl. No.: 14,198

[22] Filed: Feb. 22, 1979

[30] Foreign Application Priority Data

Feb. 23, 1978 [DE] Fed. Rep. of Germany ..... 2807720

[51] Int. Cl.[3] ..... F02M 39/00

[52] U.S. Cl. ..... 123/357; 123/501

[58] Field of Search ..... 123/139 AK, 139 AP, 123/139 AQ, 139 E, 90.15, 90.16, 496, 501, 502, 449, 357

[56] References Cited

U.S. PATENT DOCUMENTS

| | | | |
|---|---|---|---|
| 2,831,433 | 4/1958 | Seifert et al. | 123/139 AK X |
| 3,796,197 | 3/1974 | Locker et al. | 123/139 AP X |
| 3,815,564 | 6/1974 | Suda et al. | 123/139 E X |
| 4,019,478 | 4/1977 | Hobo et al. | 123/139 AP |
| 4,092,964 | 6/1978 | Höfer et al. | 123/139 AK X |
| 4,142,498 | 3/1979 | Hammond | 123/139 AP |
| 4,206,734 | 6/1980 | Perr et al. | 123/139 AK |

*Primary Examiner*—Stuart S. Levy

*Attorney, Agent, or Firm*—Edwin E. Greigg

[57] ABSTRACT

A fuel injection apparatus for internal combustion engines, in particular food Diesel engines, including a mechanically driven injection pump, preferably embodies as a pump/nozzle assembly, in which the piston speed of the pump piston is variable for the purpose of controlling the peak pressure. By means of a control apparatus, operating in accordance with rpm, the stroke motion which is transmitted from a drive cam to the pump piston is varied by shifting the effective cam range during the fuel supply stroke, or by varying the lever ratio in the drive apparatus of the pump piston in such a manner that the piston speed, which otherwise varies in proportion to the engine speed, remains either substantially constant or is adapted to a predetermined speed variation. As an additional capability, the apparatus includes a correction apparatus which compensates for an undesired variation in the onset of the fuel supply caused by the control apparatus or corrects it to a predetermined value dependent on operating characteristics of the engine.

22 Claims, 5 Drawing Figures

77
11'
82
81
78
79
83
22
26
84
76
73
74
72
24
10'
33'
71
31'
17'
14'
12
27
75
37
43
13

11'
22
75
10''
33''
35
24
91
27
14''
15''
96
37
12''
95
92
94
29
93
97
28

26
25
24
27
22'''
103
108
102
104
105
11'''
12'''
14'''
107
109
13
46
17'''
16
66
18
31'''
106
19'''
10'''
33'''
101
41
45
38
A
a
b
c
d
H
V
$v_1$
$v_2$
$v_3$
$v_4$
$a_1$
$a_2$
$\alpha$
$\alpha_1$
$\alpha_2$
$\alpha_3$
$\alpha_4$

FUEL INJECTION APPARATUS FOR INTERNAL COMBUSTION ENGINES, PARTICULARLY DIESEL ENGINES

BACKGROUND OF THE INVENTION

The invention relates to a fuel injection apparatus of a type disclosed in German Pat. No. 958,440, corresponding to U.S. Pat. No. 2,831,433, in which the injection pump is embodied as a pump/nozzle assembly. The drive apparatus of this pump/nozzle assembly substantially comprises a rocker arm driven by a drive cam mounted on a cam shaft. The arm drives the pump piston through a push rod. The rocker arm is supported on an eccentric which is rotatable by an rpm-dependent control apparatus for the purpose of varying the onset of the fuel injection. The center of the eccentric is displaced substantially transversely to the longitudinal axis of the rocker arm. The pump piston has a first oblique control edge located on its front face which serves the purpose of varying the onset of the fuel injection and a second oblique control edge, by means of which the fuel quantity to be injected can be set in a known manner when the pump piston rotates in response to a setting device.

A further fuel injection apparatus of the same general type is known from German Offenlegungsschrift (laid open patent application) No. 2,558,699, corresponding to U.S. Pat. No. 4,092,964. The fuel injection apparatus disclosed therein includes an injection pump embodied as a pump/nozzle assembly having a two part pump piston, namely, a supply piston and a diverting piston. The two pistons enclose between them an equalizing chamber filled with fluid and serving as a hydraulic push rod. The equalizing chamber is blocked by an oblique control edge on the supply piston at the beginning of supply, remains closed during the supply stroke, and is opened by the diverting piston in order to terminate the supply stroke. By means of an electrically controlled setting device, the supply piston having the oblique control edge can be rotated, in order to initiate the pumping stroke of the diverting piston at a sooner or later point in time, by closing the equalizing chamber. During the supply stroke, the diverting piston supplies fuel from a pump working chamber to the injection nozzle, the pump working chamber being provided with a fuel quantity apportioned by a fuel apportionment apparatus.

These known fuel injection apparatuses, and all injection pumps driven mechanically by a drive cam, have the inherent disadvantage that the injection pressure which is proportional to the stroke speed of the pump piston, and therefore the peak pressure as well, varies in accordance with the engine speed; while, for example, in hydraulically driven pump/nozzle assemblies the stroke speed of the pump piston and thus the injection pressure corresponding to the servo pressure remains constant or is variable when the servo pressure is regulated. Fuel injection apparatuses with hydraulically driven pump/nozzle assemblies entail a very great expense because of the pressure unit for generating the servo pressure which is required in addition to the fuel apportionment apparatus.

In order to obtain optimal performance over the entire rpm range and in order to meet the ever more stringent conditions pertaining to air purity, it would be desirable to have a fuel injection apparatus which can be produced at favorable cost and in which the injection pressure or peak pressure can be controlled in accordance with engine speed.

OBJECT AND SUMMARY OF THE INVENTION

The principal object of the invention is therefore to provide a fuel injection apparatus which is improved over that of the known apparatuses.

The fuel injection apparatus according to the invention has the advantage over the prior art of being able to influence the stroke motion of the pump piston so that the piston speed is constant over at least a wide rpm range, or adapted to a predetermined speed variation by means of the control apparatus which operates in accordance with engine speed. Thus, it is possible to attain a correction of the piston speed through the rpm-dependent control apparatus in order to at least partially compensate or vary the inherently rpm-dependent injection pressure variation. If a too-large or an undesired variation of the fuel supply initiation takes place as a result of the control apparatus which functions in accordance with rpm, then this can be compensated or corrected to a predetermined value dependent on engine operating characteristics in accordance with a further embodiment of the invention by means of a correction apparatus.

In a preferred embodiment of the invention, the inventive correction of the piston speed is enabled in that by means of the rpm-dependent control apparatus the area on the drive cam, which is effective during the supply stroke of the pump piston, is continuously displaceable in such a manner that at low rpm the pump piston supplies fuel in a range of high specific stroke speed and at high rpm it supplies fuel in a range of low specific stroke speed. A timing shaft serves as the correction apparatus which connects a cam shaft with a drive shaft of the engine and varies the reciprocal rotary position of both shafts in accordance with engine speed.

In a fuel injection apparatus having a rocker arm disposed between the cam shaft and the push rod and having a drive rod between the drive cam and the rocker arm, the drive rod embodied as a roller rod is displaceable transversely to its longitudinal direction by the rpm-dependent control apparatus. By this means, the effective area on the drive cam is controllable in a simple manner.

If the fuel injection apparatus is equipped with a two part pump piston, namely a supply piston and a diverting piston, in accordance with the above-noted German laid open application, where the supply piston is provided with an oblique control edge in order to set the onset of the fuel supply and with a setting device for its rotation, then the desired control of the piston speed can be accomplished in an advantageous manner. The setting device which causes rotation of the supply piston serves as the rpm-dependent control apparatus, by which means the area on the drive cam which is effective during the supply stroke and which is set by the rotary position of the oblique control edge on the supply piston is controllable in such a manner that the product of specific stroke speed and rpm, when the engine speed is varying, remains nearly constant or is adaptable in a predetermined manner.

A precise and flexible control of the fuel injection apparatus and an exact adaptation to the parameters which influence the injection can be obtained in that the control apparatus and the correction apparatus can be turned on by an electronic regulating apparatus, whereby all operational data such as rpm, load, charge pressure, atmospheric pressure, air and engine temperature, and so forth, can be controlled with the necessary precision, if necessary in accordance with a performance graph program.

In a further embodiment of the fuel injection apparatus in accordance with the invention, and which corresponds in its known aspects to that apparatus disclosed in German Pat. No. 958,440, according to which a rocker arm is disposed between the cam shaft and the push rod and is supported on an eccentric of an adjustment shaft of the drive apparatus, the adjustment shaft being rotatable by a control member of the control apparatus in accordance with engine speed, the speed control can be obtained in accordance with the invention in the following manner: the change in position of the eccentric when the adjustment shaft rotates takes place substantially in the direction of the longitudinal axis of the rocker arm, and the effective length of the lever arm of the rocker arm, which preferably contacts a pressure lobe on the push rod, is reduced at increasing rpm and is enlarged at decreasing rpm. In this case, the inventive speed variation is accomplished by a change in lever ratio in the drive, whereby the effective area on the drive cam during the supply stroke of the pump piston remains substantially the same, independently of the rpm. The variation in the onset of fuel supply caused by eccentric stroke can then be compensated for, if such a variation is not desired, in that the pressure lobe of the lever arm contacting the push rod (preferably embodied as a roller rod) serves as the correction apparatus and is provided with a cam-shaped elevation, by means of which the stroke motion of this lever arm, which automatically takes place when the eccentric rotates, is at least nearly compensated. This cam-shaped elevation can also be advantageously embodied in that besides the compensation of the automatic stroke motion of the lever arm of the rocker arm contacting the push rod, a variation of the stroke position of the pump piston which determines the onset of the fuel supply can be accomplished through the control apparatus, and this variation serves to shift the onset of the fuel supply in an rpm-dependent manner.

A variation in the onset of the fuel supply, which is completely independent of the control apparatus is attainable by the fuel injection apparatus according to FIG. 4.

DESCRIPTION OF THE PREFERRED EMBODIMENTS

Figure 1:
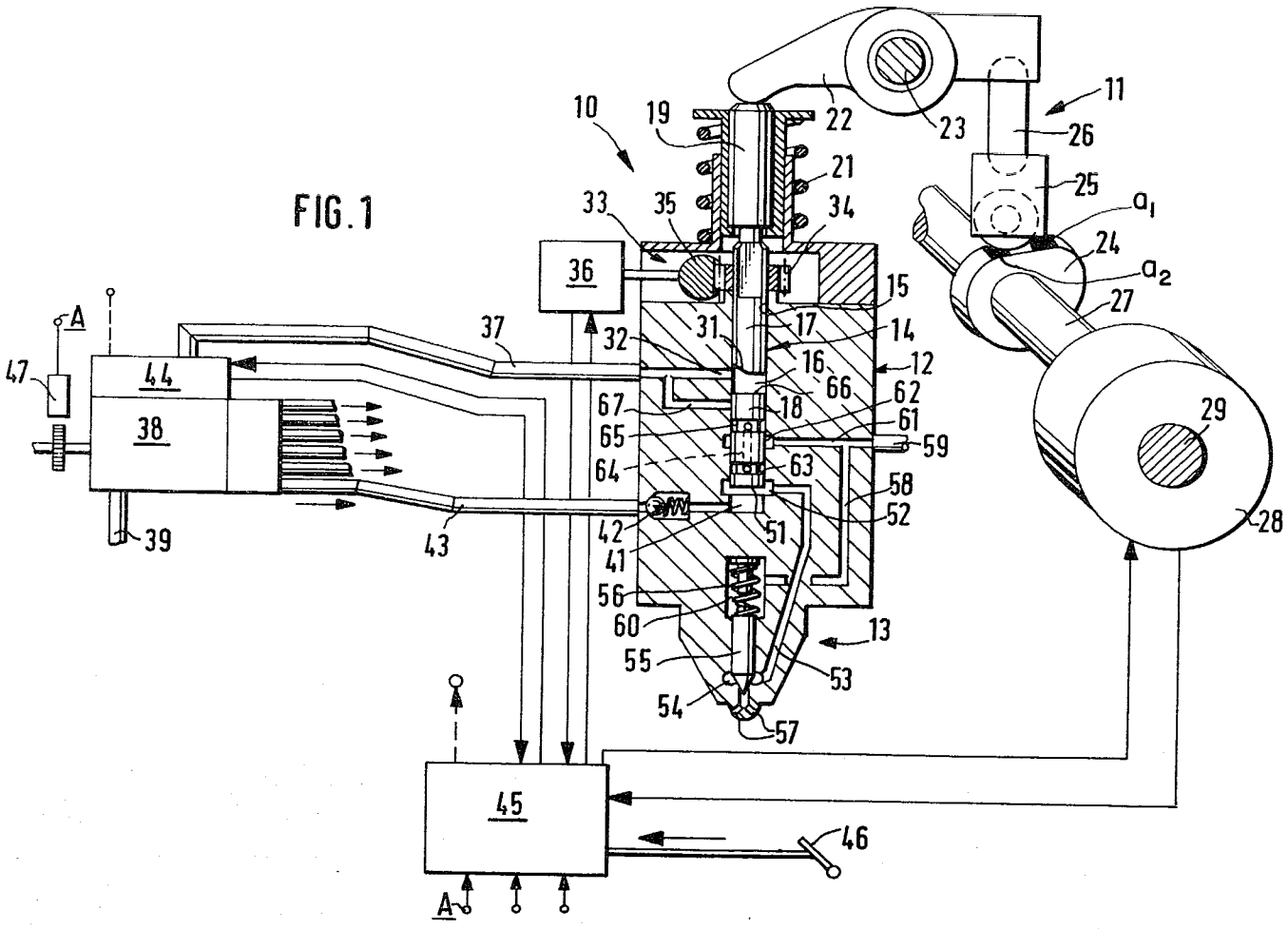
FIG. 1 is a schematic view partly in cross-section illustrating, in simplified form, a first embodiment of the invention with an injection pump embodied as a pump-/nozzle assembly.

In the fuel injection apparatus shown in FIG. 1, there is shown a mechanically driven pump/nozzle assembly 10 which substantially comprises an injection pump 12 embodied as a piston pump and driven by a drive apparatus 11, and an injection nozzle 13 embodied as a pressure-controlled injection valve which is built as a unit with the pump 12. A pump piston 14 is guided within a pump cylinder 15 and comprises two pistons 17 and 18 coupled together via a fluid-filled equalizing chamber 16 which serves as a hydraulic push rod. The first piston, supply piston 17, is provided with a push rod 19 of the drive apparatus 11, which is actuated against the force of a return spring 21 by a rocker arm 22 also of the drive apparatus 11.

The rocker arm 22 is supported on a shaft 23 fixed within the cylinder head of the engine and is driven by a drive cam 24 via a drive rod 25, embodied as a roller rod, and a connecting rod 26. The drive cam 24 is fixed on a cam shaft 27, which is connected with a drive shaft 29 rotating in synchronism with the engine crankshaft by way of the interposition of a known, for example from U.S. Pat. No. 3,815,564, preferably electro-hydraulically driven timing shaft 28. The supply piston 17 is provided on its front face oriented toward the equalizing chamber 16 with an oblique control edge 31, which cooperates with a control aperture 32 in the wall of the pump cylinder 15 in order to control the onset of the fuel supply. The supply piston 17 is rotatable via a known setting device 33 serving as an rpm-dependent control apparatus. The setting device 33 substantially comprises a setting pinion 34, an adjusting rod 35, and a control apparatus 36 which actuates the adjusting rod 35 in an rpm-dependent manner.

Fuel at pre-supply pump pressure is delivered via a line 37 and the control aperture 32, and serves as an operating fluid for the equalizing chamber 16 between the pistons 17 and 18. The fuel is drawn from a distributor-type injection pump 38 acting as the fuel apportionment apparatus. In a known manner, which will therefore not be described in detail, the fuel is delivered to the distributor-type pump 38 from a pre-supply pump via a supply line 39, and the distributor-type pump 38 provides a pump work chamber 41 below the diverting piston 18 with a precisely apportioned fuel quantity during the intervals between injections, via one of its refill lines 43, each of which has a refill valve 42. Any desired known apparatus which supplies a precisely apportioned fuel quantity at relatively low pressure can serve as the fuel apportionment apparatus. The distributor-type pump 38 is provided with an electrical regulator 44, which is controlled, along with the control apparatus 36 and the timing shaft 28, by an electronic controller 45.

The electronic controller 45, in a known manner, contains an rpm or refill regulator, whose set-point value is provided by the accelerator pedal 46, and which processes an rpm signal A of an rpm transducer 47 mounted on the drive shaft of the distributor-type pump 38.

The pump work chamber 41 defined by a front face 51 of the diverting piston 18 communicates by way of an annular chamber 52 and a subsequent pressure line 53 with a pressure chamber 54 of the injection nozzle 13. In the pressure chamber 54 the fuel pressure is exerted in a known manner on the pressure shoulder of a valve needle 55 and moves the needle 55 against the force of a valve spring 56 so that the valve opens. Thus the fuel expelled from the pump work chamber 41 is injected through nozzle bores 57 into the engine cylinder during the supply stroke of the pump piston 14. A spring chamber 60 surrounding the valve spring 56 is attached via a drainage bore 48 to a pressure-free return line 59, which leads back to the fuel tank (not shown) of the fuel injection system or, if desired, empties into the line 37 which is under pre-supply pump pressure. A relief line 61 is also attached to the return line 59, and extends from an annular chamber 62 machined into the wall of the pump cylinder 15. The relief line 61 serves to relieve the pressure chamber 54 and the pressure line 53 of the injection nozzle 13, whenever the annular chamber 52 is connected with the annular chamber 62 simultaneously with or shortly after the termination of pump supply. When the annular chamber 52 is closed by the front face 51 of the diverting piston 18, which terminates pump supply, this connection (between chambers 52 and 62) is made via a first annular groove 63 which at that time enters communication with the annular chamber 52, and further via a relief channel 64 and a second annular groove 65 on the diverting piston 18. After the connection between the pump work chamber 41 and the pressure line 53 is closed, a connection channel 67 is opened by means of a front face 66 of the diverting piston 18 which faces the equalizing chamber 16, by means of which the operating fuel enclosed in the equalizing chamber 16, and serving as a hydraulic buffer, can escape into the line 37, so that the diverting piston 18 terminates its pumping stroke, but the supply piston 17 can continue a pumping stroke which has been predetermined by the drive cam 24 until the stroke is ended.

In the described pump/nozzle assembly 10, the setting device 33 does not serve in the conventional manner to vary the onset of the fuel supply, but rather effects rotation of the supply piston 17. The supply piston 17 is controlled by the control apparatus 36 in an rpm-dependent manner, and in accordance therewith the position of the oblique control edge 31 is controlled. The area on the drive cam 24 which is effective during the fuel supply stroke of the pump piston 14 is preselected, and a variation in this area, and thus in the onset of the fuel supply, is set back, that is, compensated or corrected, to a value preset by the controller 45 in accordance with operating characteristics of the engine, with these adjustments being performed by means of the timing shaft 28 which here acts as a correction apparatus. The inventive cooperation of the setting device 33 and the timing shaft or correction apparatus 28 is described in further detail below, where the mode of operation is described, and with the aid of FIG. 5.

Figure 2:
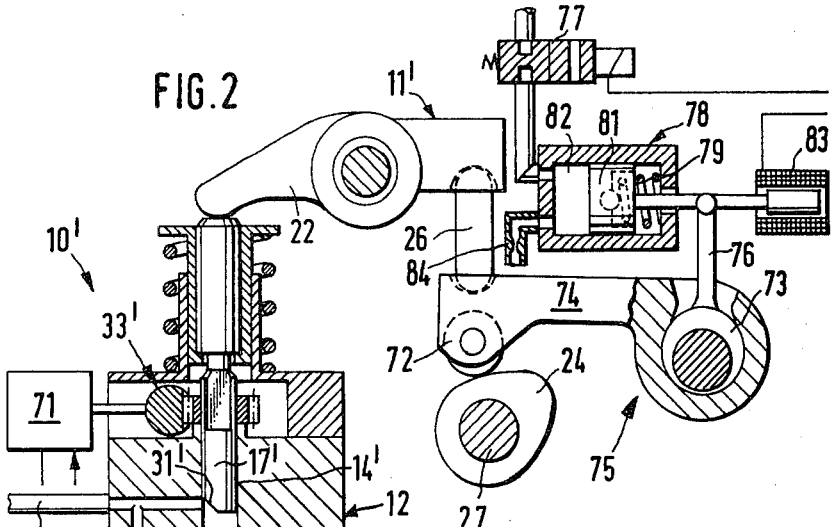
FIG. 2 illustrates a pump/nozzle assembly of a second embodiment.

In FIG. 2, only the pump/nozzle assembly 10' and the drive apparatus 11' of the second embodiment are shown. (Parts which are the same as in the first embodiment shown in FIG. 1 have the same reference numeral, and those which are the same but whose function has varied or parts which have the same effect are marked with a prime designation).

The piston pump 12 and the injection nozzle 13 are identical with those of FIG. 1, but the oblique control edge 31' on the supply piston 17' has a function which has been varied from that of the control edge 31 in FIG. 1, as will be described in further detail below. The setting device 33' here acts as a correction apparatus and is actuated by a control device 71. The setting device 33' performs the same function in this embodiment as does the timing shaft 28 of FIG. 1.

The rocker arm 22 of the drive apparatus 11' is actuated via the connecting rod 26 by a drive rod 72 embodied as a roller rod on the end of a drive lever 74 pivotally supported on an eccentric 73. The drive lever 74 is part of an rpm-dependent control apparatus 75. The control apparatus 75 has an eccentric 73 pivotable, in order to vary the position of the roller rod 72, via a lever 76 by a piston control element 78 supplied with hydraulic pressure by a solenoid valve 77. A piston 81 operating against the force of a spring 79 is adjusted into a position predetermined by the associated control arrangement by means of pressure fluid delivered into a pressure chamber 82 by the solenoid valve 77. This position is fed back via a path transducer 83 and is thus regulated. The pressure fluid delivered into the pressure chamber 82 then flows out via a return flow throttle 84.

The displacement of the roller rod 72 transverse to its stroke direction effected by rotation of the eccentric 73 produces a varied effective area of the drive cam 24 during the pump supply, and an undesirable shifting of supply onset thereupon occurring is compensated by the setting device 33'. Thus in the embodiment of FIG. 2, the control apparatus 75 functionally corresponds to the setting device 33 of FIG. 1, and the setting device 33' corresponds to the correction apparatus 28 of FIG. 1.

Figure 3:
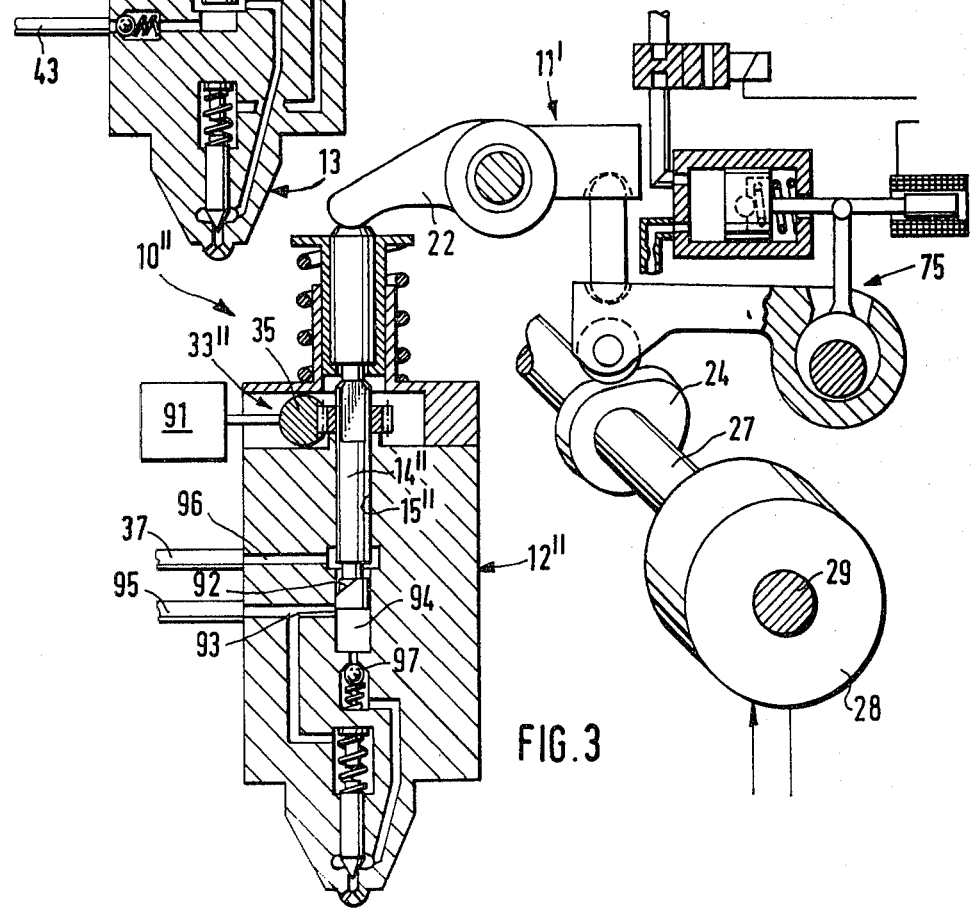
FIG. 3 illustrates a pump/nozzle assembly of a third embodiment.

The pump/nozzle assembly 10'' of the third embodiment shown in FIG. 3 is equipped with the same drive apparatus 11' and control apparatus 75 as the second embodiment of FIG. 2. While in the second embodiment of FIG. 2 the cam shaft 27 is directly connected with a drive shaft (not shown) of the engine, the cam shaft 27 in FIG. 3 is connected, in the same manner as in the first embodiment of FIG. 1, via a timing shaft 28, acting as the correction apparatus, with the drive shaft 29 of the engine. Since in the fuel injection apparatus of FIG. 3 both the rpm-dependent control arrangement 75 and the correction apparatus 28 are disposed in the drive of the pump/nozzle assembly 10'', the pump/nozzle assembly can be embodied in any desired fashion. In the pump/nozzle assembly 10'' the adjusting rod 35 of the setting device 33, which is displaceable by a control apparatus 91, serves in a known manner to control the quantity of fuel to be injected. A pump piston 14'' is equipped with an oblique control edge 92, which after the pumping stroke has taken place opens a control aperture 93 in the wall of the pump cylinder 15'' and connects the pump work chamber 94 with a pressure-relieved return line 95. The fuel supply takes place via a line 96. The injection nozzle 13 included as a unit with the piston pump 12'' is attached via a pressure valve 97 to the pump work chamber 94.

Figures 4, 5:
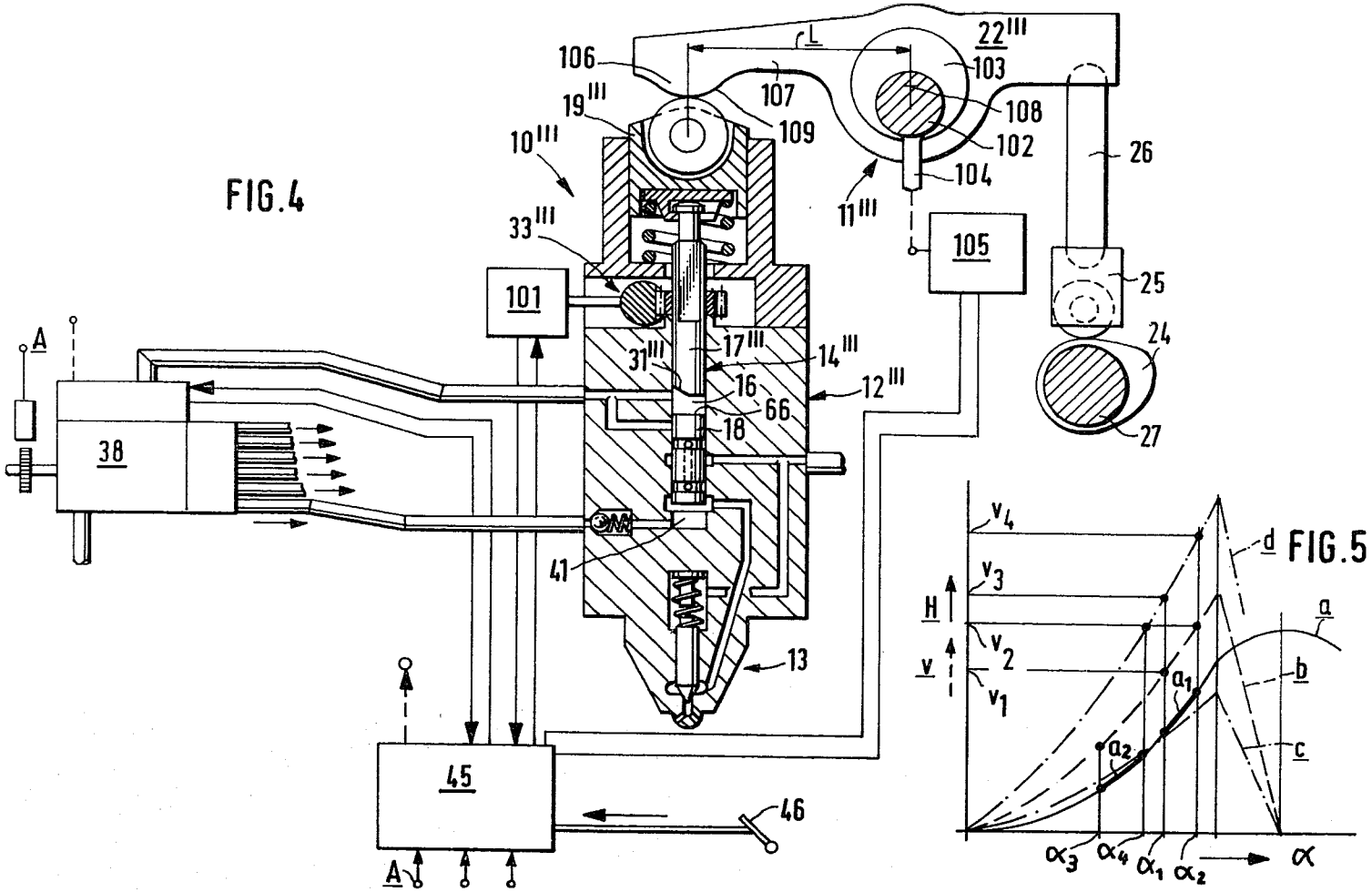
FIG. 4 illustrates a fourth embodiment of a fuel injection apparatus according to the invention.
FIG. 5 is a diagram showing the cam stroke speed and the piston speed.

The fourth embodiment of a fuel injection apparatus embodied in accordance with the invention, shown in FIG. 4, has a pump/nozzle assembly 10''', whose pump piston 14''' is driven by a push rod 19''' embodied as a roller rod. The piston pump 12''' and injection nozzle 13 are identical to those in FIG. 1, except that the control apparatus 101 of the setting device 33''' here serves in a known manner to effect the setting of the fuel supply onset which is controllable by the controller 45. The drive apparatus 11''' has a rocker arm 22''', which is pivotally supported on an eccentric 103 fixed on an adjustment shaft 102. The drive of the rocker arm 22''' takes place via the connecting rod 26 and the drive rod 25 by means of the drive cam 24 fixed on the cam shaft 27. The adjustment path of the eccentric 103 is rotatable via a setting lever 104 by means of a further control apparatus 105 regulated in accordance with the rpm by the controller 45. By this means, the effective length L of a lever arm 104 of the rocker arm 22''' which contacts a pressure lobe 105 on the push rod 19''' can be varied. In accordance with the invention this variation takes place in such a manner that when the rpm is increasing the lever arm 107 is shortened and when the rpm is decreasing it is lengthened. Through the thus attained variation in the lever ratio of the rocker arm 22''', in accordance with the invention, the piston speed of the pump piston 14 is increased or decreased, in order either to maintain a constant piston speed or to adapt the piston to a predetermined speed, when the engine speed is varying. Since when the center point 108 of the eccentric 103 is shifted and when the position of the drive cam 24 is fixed, the pressure lobe 106 performs a stroke movement which would lead to a variation in the onset of injection if the supply piston 17 were not regulated, the pressure lobe 106 is equipped with a cam-shaped elevation 109, by means of which the automatic stroke motion of the lever arm 107 resulting from the rotation of the eccentric 103 is compensated. If in addition to compensating the automatic stroke motion of the lever arm 107 contacting the push rod 19''' it is desired to vary the stroke position of the pump piston 14''' determining the rpm dependent onset of the pressure lobe 106 can be provided with a corresponding curved contour. Thus the pressure lobe 106 serves as the correction apparatus.

If the correction of injection onset is not performed by the pressure lobe 106, then, as in the embodiment of FIG. 2, the setting device 33 actuated by the control apparatus 101 can perform the supply onset correction. Since in the embodiment of FIG. 4 the desired speed variation of the pump piston 14''' is controllable by means of the further control apparatus 105 and the pressure lobe 106, which are combined into a unit in the drive apparatus 11''' in accordance with the invention, then in this case the structural design of the pump/nozzle assembly is of less significance and is only dependent upon other requirements, such as the need for a separate regulation for fuel quantity and for supply onset.

FIG. 5 is a diagram of the cam stroke speed and the piston speed for all the embodiments shown in FIGS. 1 through 4. The sine-shaped curve a shown by the solid line represents the cam stroke H viewed along the ordinate as a function of the cam angle $\alpha$, and the broken-line curve b represents the profile of the speed v of the pump pistons 14, 14' and 14'' at a fixed lever ratio of the rocker arm 22. The dot-dash curves c and d represent speed curves of the pump piston 14''' of FIG. 4. The low piston speed c of the piston 14''' occurs when the effective length L of the lever arm 107 of the rocker arm 22''' is shortened, and in accordance with the invention this takes place at high rpm; the higher piston speed shown in curve d is settable at lower rpm. The essential function according to the invention of the four embodiments will now be described with the aid of FIGS. 1 through 4 and 5.

In the first embodiment shown in FIG. 1, the fuel to be injected is prestored in the pump work chamber 41, being drawn from the distributor-type pump 38 via the refill line 43 and the refill valve 42. Thus the diverting piston 18 is displaced in the direction of the supply piston 17 in accordance with the prestored injection quantity. If the drive cam 24 now rotates counterclockwise, the supply piston 17 moves toward the diverting piston 18 and expels fuel from the equalizing chamber 16 into the line 37, until the control edge 31 closes the countrol aperture 32. This point is attained, for example, at low speed and at a cam angle $\alpha_1$ (FIG. 5). When the cam 24 rotates further, the fuel now enclosed in the equalizing chamber 16 acts as a hydraulic push rod and drives the diverting piston 18. Thereby the apportioned fuel is expelled from the pump work chamber 41 via the pressure line 53 to the pressure chamber 54, and is injected when the valve needle 55 is opened into the engine cylinder via the nozzle openings 57. At the cam angle $\alpha_2$ (FIG. 5), the lower defining edge of the annular chamber 52 is closed by the front face 51 of the diverting piston 18, the pump supply is terminated, and the pressure chamber 54 at the injection nozzle 13 is relieved via the relief channel 64 and the relief line 61 toward the return line 59. Simultaneously, or shortly thereafter, the second front face 66 of the diverting piston 18 opens the connection channel 67, and the diverting piston 18 ends its pumping stroke. During the remaining stroke of the supply piston 17, fuel is expelled from the equalizing chamber 16 via the connection channel 67 to the line 37.

In FIG. 5, the described stroke area on the drive cam 24 is represented by the section $a_1$ of the curve a. The associated stroke speed of the pump piston then moves between $v_1$ and $v_2$.

If the engine increases its speed and the drive shaft 29 and the cam shaft 27 therefore rotate faster, then in accordance with the rpm signal A fed from the rpm tranducer 47 into the controller 45 the setting device 33 of the supply piston 17 is actuated via the rpm-dependent control apparatus 36 in such a manner that the pump supply takes place in a cam area between the cam angles $\alpha_3$ and $\alpha_4$. Without the timing shaft 28, which serves as the correction apparatus, an injection onset set back to $\alpha_3$ at the engine would as a rule cause an impermissibly early injection onset. In order to compensate for this shift, the timing shaft 28 is also controlled in an rpm-dependent manner, together with the control apparatus 36, by the controller 45 and the rotary position of the cam shaft 27 as compared to the drive shaft 29 is set back to the differential amount between the angles $\alpha_1$ and $\alpha_3$.

As was described above, a desired rpm-dependent or load-dependent adjustment of the onset of the fuel supply can be controlled by means of a corresponding correction of the control signal for the timing shaft 28. Likewise, by means of the controller 45, instead of a compensation of the stroke speed arising as a result of the change in engine speed, a correction of the stroke speed, which is adapted to a pre-set speed can be controlled. The stroke speed transmitted to the pump piston 14 in the corresponding cam area, for example $a_1$, varies between $v_1$ and $v_2$, whereby the particular highest speed at the time determines the peak pressure in the injection system. The peak pressure can be maintained virtually constant when the effective area on the drive cam 24 during the supply stroke of the pump piston 14 is shifted in such a manner that the pump piston 14 supplies a range of high specific stroke speed at a low rpm value in the range $a_1$ and supplies a range of low specific stroke speed at a high rpm value in the range $a_2$.

As already described in connection with FIG. 2, in the second embodiment the rpm-dependent control apparatus 75 serves the selection of the effective cam area, for example $a_1$ or $a_2$, and the necessary fuel supply onset correction is performed by the control device 71 which actuates the setting device 33'.

In the third embodiment of FIG. 3, the selection of the effective cam area is a result of the control apparatus 75 as in the embodiment of FIG. 2, but the fuel supply onset correction is undertaken by the timing shaft 28.

In the fourth embodiment of FIG. 4, which operates on a different principle, the effective area on the drive cam 24 does not change, but rather the necessary stroke speed variation is obtained by changing the lever ratio in the drive apparatus 11'''. If the pump piston 14''' of this injection apparatus supplies between the cam angles, for example, of $\alpha_1$ and $\alpha_2$ (FIG. 5) and the engine is running slowly, then a lever ratio of the rocker arm 22''' is set which produces, for example, an increased cam speed in accordance with the curve d, so that the pump piston experiences an increased specific stroke speed which is increased to a speed between $v_3$ and $v_4$. At high rpm, this specific stroke speed is reduced, for example, to the values set by the curve c, so that the product of specific stroke speed and rpm when the rpm is varying remains at least approximately constant or is adapted to a predetermined value.

What is claimed and desired to be secured by Letters Patent of the United States is:

1. A fuel injection apparatus for an internal combustion engine, and in particular for a Diesel engine, comprising:

a fuel injection pump including means defining a pump cylinder, and a pump piston guided within the pump cylinder;

a drive apparatus including a push rod;

a cam shaft;

a drive cam mounted for rotation on the cam shaft, said drive cam mechanically driving the pump piston through the push rod of the drive apparatus;

an injection nozzle connected to the pump, said nozzle opening in response to an injection pressure which is rpm-dependent;

a control apparatus which operates in dependence on rpm;

a correction apparatus; and an electronic controller connected to the control apparatus and to the correction apparatus, wherein:

(i) the drive cam is formed to transmit a stroke motion to the pump piston during the supply of fuel to be injected;

(ii) the onset of the fuel supply is corrected to a predetermined value dependent on operating characteristics of the engine thereby compensating for an undesirable onset of the fuel supply effected by the control apparatus;

(iii) the control apparatus and the correction apparatus are controlled by the electronic controller; and (iv) the stroke motion transmitted by the drive cam is effected by the electronic controller and the correction apparatus in such a manner that the piston speed, which otherwise varies in proportion to engine speed, is corrected so that it remains substantially constant, thereby compensating for the rpm-dependent injection pressure variations, due to the variations in piston speed.

2. The fuel injection apparatus as defined in claim 1, wherein the pump and nozzle are combined into an assembly.

3. The fuel injection apparatus as defined in claim 1, wherein:

(v) the drive apparatus further includes: a rocker arm disposed between the cam shaft and the push rod, said rocker arm having a lever arm the end of which defines a pressure lobe which contacts the push rod; and an adjustment shaft having an eccentric on which the rocker arm is mounted;

(vi) the control apparatus includes a setting lever which effects rotation of the adjustment shaft in dependence on rpm;

(vii) the positional variation of the eccentric as a result of rotation of the adjustment shaft by the setting lever takes place substantially in the longitudinal direction of the rocker arm; and (viii) the effective length of the rocker arm lever is shortened when the rpm increases, and is lengthened when the rpm decreases.

4. The fuel injection apparatus as defined in claim 3, wherein:

(ix) the push rod is embodied as a roller rod;

(x) the pressure lobe serves as the correction apparatus and includes a cam-shaped elevation by means of which the stroke motion of the lever arm of the rocker arm, which automatically occurs when the eccentric of the adjustment shaft is rotated, is at least approximately compensatable.

5. The fuel injection apparatus as defined in claim 4, further comprises:

a further control apparatus, and wherein:

(xi) the cam-shaped elevation is embodied so that a variation, serving to displace the rpm dependent onset of the fuel supply, is attainable by means of the further control apparatus for the stroke position of the pump piston.

6. The fuel injection apparatus as defined in claim 1, wherein:

(v) two effective areas are defined on the drive cam surface; and (vi) the drive cam is continuously displaceable by means of the electronic controller such that one of said effective areas is engaged at low rpm and high specific stroke speed and the other of said effective areas is engaged at high rpm and low specific stroke speed.

7. The fuel injection apparatus as defined in claim 6, further comprising:

a timing shaft, and wherein:

(vii) the timing shaft serves as the correction apparatus and connects the cam shaft to the engine drive shaft, and varies the mutual rotary position of the two shafts in dependence on rpm.

8. The fuel injection apparatus as defined in claim 6, wherein:

(vi) the drive apparatus further includes: a rocker arm disposed between the cam shaft and the push rod; and a drive rod disposed between the drive cam and the rocker arm; and (vii) the drive rod comprises a roller rod which is displaceable by the control apparatus transversely to the longitudinal axis of the cam shaft.

9. The fuel injection apparatus as defined in claim 8, further comprising:

a control device; and a setting device actuatable by the control device, and wherein:

(viii) the pump piston includes an oblique control edge; and (ix) the setting device serves as the correction apparatus which effects rotation of the pump piston.

10. The fuel injection apparatus as defined in claim 9, further comprising:

an electronic controller, and wherein:

(x) the control apparatus and the correction apparatus are controlled by the electronic controller.

11. A fuel injection apparatus for an internal combustion engine, and in particular for a Diesel engine, comprising:

a fuel injection pump including means defining a pump cylinder, and a pump piston guided within the pump cylinder;

a drive apparatus including a push rod;

a cam shaft;

a drive cam mounted for rotation on the cam shaft, said drive cam mechanically driving the pump piston through the push rod of the drive apparatus;

an injection nozzle connected to the pump, said nozzle opening in response to an injection pressure which is rpm dependent;

a control apparatus which operates in dependence on rpm;

a correction apparatus; and an electronic controller connected to the control apparatus and to the correction apparatus, wherein:

(i) the drive cam is formed to transmit a stroke motion to the pump piston during the supply of fuel to be injected;

(ii) the onset of the fuel supply is corrected to a predetermined value dependent on operating characteristics of the engine, thereby compensating for an undesirable onset of the fuel supply effected by the control apparatus;

(iii) the control apparatus and the correction apparatus are controlled by the electronic controller; and (iv) the stroke motion transmitted by the drive cam is effected by the apparatus in such a manner that the piston speed, which otherwise varies in proporation to engine speed, is corrected so that it is adaptable to a predetermined speed variation, thereby compensating for the rpm-dependent injection pressure variations, due to the variations in piston speed.

12. The fuel injection apparatus as defined in claim 11, wherein the pump and nozzle are combined into an assembly.

13. The fuel injection apparatus as defined in claim 11, wherein:

(v) the drive apparatus further includes: a rocker arm disposed between the cam shaft and the push rod, said rocker arm having a lever arm the end of which defines a pressure lobe which contacts the push rod; and an adjustment shaft having an eccentric on which the rocker arm is mounted;

(vi) the control apparatus includes a setting lever which effects rotation of the adjustment shaft in dependence on rpm;

(vii) the positional variation of the eccentric as a result of rotation of the adjustment shaft by the setting lever takes place substantially in the longitudinal direction of the rocker arm; and (viii) the effective length of the rocker arm lever is shortened when the rpm increases, and is lengthened when the rpm decreases.

14. The fuel injection apparatus as defined in claim 13, wherein:

(ix) the push rod is embodied as a roller rod;

(x) the pressure lobe serves as the correction apparatus and includes a cam-shaped elevation by means of which the stroke motion of the lever arm of the rocker arm, which automatically occurs when the eccentric of the adjustment shaft is rotated, is at least approximately compensatable.

15. The fuel injection apparatus as defined in claim 14, further comprises:

a further control apparatus, and wherein:

(xi) the cam-shaped elevation is embodied so that a variation, serving to displace the rpm dependent onset of the fuel supply, is attainable by means of the further control apparatus for the stroke position of the pump piston.

16. The fuel injection apparatus as defined in claim 11, wherein:

(v) two effective areas are defined on the drive cam surface; and (vi) the drive cam is continuously displaceable by means of the electronic controller such that one of said effective areas is engaged at low rpm and high specific stroke speed and the other of said effective areas is engaged at high rpm and low specific stroke speed.

17. The fuel injection apparatus as defined in claim 16, further comprising:

a timing shaft, and wherein:

(vii) the timing shaft serves as the correction apparatus and connects the cam shaft to the engine drive shaft, and varies the mutual rotary position of the two shafts in dependence on rpm.

18. The fuel injection apparatus as defined in claim 16, wherein:

(vii) the drive apparatus further includes: a rocker arm disposed between the cam shaft and the push rod; and a drive rod disposed between the drive cam and the rocker arm; and (viii) the drive rod comprises a roller rod which is displaceable by the control apparatus transversely to the longitudinal axis of the cam shaft.

19. The fuel injection apparatus as defined in claim 18, further comprising:

a control device; and a setting device actuatable by the control device, and wherein:

(ix) the pump piston includes an oblique control edge; and (x) the setting device serves as the correction apparatus which effects rotation of the pump piston.

20. The fuel injection apparatus as defined in claim 19, further comprising:

an electronic controller, and wherein:

(xi) the control apparatus and the correction apparatus are controlled by the electronic controller.

21. A fuel injection apparatus for an internal combustion engine, and in particular for a Diesel engine, comprising:

a fuel injection pump including: means defining a pump cylinder; a two part piston consisting of a supply piston and a diverting piston; a fluid filled equalizing chamber enclosed between the two pistons, said equalizing chamber serving as a hydraulic push rod; an obliquely disposed control edge on the supply piston; a control aperture formed in the wall of the means defining the pump cylinder; and a pump work chamber within which an apportionment quantity of fuel is prestored;

a drive cam for mechanically driving the supply piston, said drive cam defining two effective areas on its surface; and a setting device for rotating the supply piston, said setting device serving as an rpm-dependent control apparatus, wherein:

(i) the equalizing chamber is blocked at the onset of the fuel supply by the control edge on the supply piston cooperating with the control aperture, is closed during the supply stroke, and relieved by the diverting piston in order to terminate the supply stroke; and (ii) the effective areas on the drive cam are controllable by the setting device in such a manner that the specific stroke speed effective during fuel supply, when the rpm is varying, remains substantially constant.

22. A fuel injection apparatus for an internal combustion engine, and in particular for a Diesel engine, comprising:

a fuel injection pump including: means defining a pump cylinder; a two part pump piston consisting of a supply piston and a diverting piston; a fluid filled equalizing chamber enclosed between the two pistons, said equalizing chamber serving as a hydraulic push rod; an obliquely disposed control edge on the supply piston; a control aperture formed in the wall of the means defining the pump cylinder; and a pump work chamber within which an apportionment quantity of fuel is prestored;

a drive cam for mechanically driving the supply piston, said drive cam defining two effective areas on its surface; and setting device for rotating the supply piston, said setting device serving as an rpm-dependent control apparatus, wherein:

(i) the equalizing chamber is blocked at the onset of the fuel supply by the control edge on the supply piston cooperating with the control aperture, is closed during the supply stroke, and relieved by the diverting piston in order to terminate the supply stroke; and (ii) the effective areas on the drive cam are controllable by the setting device in such a manner that the specific stroke speed effective during fuel supply, when the rpm is varying, is adaptable to a predetermined speed variation.

* * * * *